US006484675B2

(12) United States Patent
Pierik

(10) Patent No.: US 6,484,675 B2
(45) Date of Patent: Nov. 26, 2002

(54) HYDRAULIC ACTUATOR FOR VARIABLE VALVE MECHANISM

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/792,254

(22) Filed: Feb. 22, 2001

(65) Prior Publication Data

US 2001/0025613 A1 Oct. 4, 2001

Related U.S. Application Data

(60) Provisional application No. 60/184,301, filed on Feb. 23, 2000.

(51) Int. Cl.[7] ..... F01L 1/34

(52) U.S. Cl. ..... 123/90.15; 123/90.16; 123/90.17

(58) Field of Search ..... 123/90.15, 90.17, 123/90.16, 90.12; 92/121, 122, 123, 124, 125

(56) References Cited

U.S. PATENT DOCUMENTS 4,696,265 A * 9/1987 Nohira ..... 123/90.16
5,649,506 A * 7/1997 Melchior ..... 123/90.17
6,173,687 B1 * 1/2001 Fukuhara et al. ..... 123/90.17
6,260,523 B1 * 7/2001 Nakamura et al. ..... 123/90.15

* cited by examiner

*Primary Examiner*—Weilun Lo
(74) *Attorney, Agent, or Firm*—Patrick M. Griffin

(57) ABSTRACT

A hydraulic actuator includes an elongate cylinder having a central axis, a sidewall, a top and a bottom. The sidewall is interconnected with the top and bottom in an air and fluid tight manner. An elongate control shaft has a first portion disposed within the cylinder and is substantially parallel with the central axis thereof. The control shaft extends in an axial direction through the top and is engaged thereby in an air and fluid tight manner. A second portion of the control shaft is disposed external to the cylinder. The second portion of the control shaft is configured for being pivotally coupled to at least one variable valve mechanism. A fixed vane is disposed in sealing engagement with the sidewall, top and bottom of the cylinder, and with the first portion of the control shaft. A movable vane is in sealing engagement with the top and bottom of the cylinder. The movable vane has an inner end affixed to the first portion of the control shaft, and an outer end engaging the sidewall of the cylinder in an air and fluid tight manner.

8 Claims, 4 Drawing Sheets

HYDRAULIC ACTUATOR FOR VARIABLE VALVE MECHANISM

CROSS-REFERENCE TO RELATED APPLICATIONS

This application claims the benefit of U.S. Provisional Patent Application Serial No. 60/184,301, filed Feb. 23, 2000.

TECHNICAL FIELD

The present invention relates to actuators for variable valve mechanisms of internal combustion engines.

BACKGROUND OF THE INVENTION

A variable valve mechanism controls the valve lift profile (i.e., the amount and duration of lift) of one or more associated valves of an engine in response to engine operating parameters, such as, for example, engine load, speed, and driver input. Generally, the valve lift profile is set by an actuator which varies the angular position of a control shaft which, in turn, varies the angular position of the variable valve mechanism relative to a central axis of an input shaft or camshaft of the engine to which the variable valve mechanism is pivotally mounted.

Actuators for variable valve mechanisms typically include an electric motor and gearbox. One example of an actuator for a variable valve mechanism is described in commonly-assigned U.S. Pat. No. 6,019,076, which is incorporated herein by reference. The gearbox includes a worm which engages a worm gear disposed on or connected to the control shaft. When a change in the valve lift profile is desired, the electric motor rotates the worm, which, in turn, rotates the worm gear. Rotation of the worm gear pivots the control shaft relative to its central axis which, in turn, angularly positions the variable valve mechanism relative to the central axis of the camshaft to thereby establish a desired valve lift profile.

The input or camshaft of the engine is driven by the engine and rotates three-hundred sixty degrees. As stated herein, the variable valve mechanism is pivotally mounted on an input shaft or camshaft of the engine. Thus, the variable valve mechanism is subjected to torque as a result of the rotation of the camshaft or input shaft to which it is pivotally mounted. This torque is reflected from the variable valve mechanism through the control shaft and back to the actuator. A spring acts upon the worm gear and/or the control shaft to substantially balance the positive and negative peaks of the reflected torque to which the control shaft and actuator are subjected. In the static state, i.e., when the control shaft is stationary, the pressure and lead angles of the teeth of the worm and worm gear are designed such that torque reflected from the variable valve mechanism through the control shaft causes the worm and the worm gear to lock up. The locking of the worm and worm gear in the static state prevent the reflected torque from being transmitted to the motor. However, in order to pivot the control shaft, the motor must be adequately powered to unlock the worm and worm gear and to overcome the reflected torque.

During rotation of the control shaft, the worm and worm gear are no longer interlocked. Thus, the motor is subjected to the reflected torque peaks. The reflected torque peaks may reach a large enough magnitude and, if directed opposite to the direction of motor rotation, cause the worm and worm gear to lock up and the motor to stall. The motor will remain stalled until the momentary torques decrease and the motor is again able to drive the mechanism in the desired direction.

Such conventional actuators require numerous parts, complicated control means, and lash adjustment systems to compensate for tolerances in manufacturing, temperature changes, and wear. The motor and gearbox must be relatively large and powerful in order to overcome the reflected torque peaks, and thus consume a substantial amount of space. An overpowered motor is relatively expensive and heavy.

Therefore, what is needed in the art is an actuator for variable valve mechanisms that has fewer parts and is therefore less expensive.

Still further, what is needed in the art is an actuator for variable valve mechanisms that requires no lash adjustment system.

Even further, what is needed in the art is an actuator for variable valve mechanisms that is less sensitive to and less affected by reflected torque.

Moreover, what is needed in the art is an actuator for variable valve mechanisms that is less dependent upon, or which completely eliminates, the motor and gearbox, thereby reducing the overall size, weight and cost of the actuator.

SUMMARY OF THE INVENTION

The present invention provides a hydraulic actuator.

The present invention comprises, in one form thereof, an elongate cylinder having a central axis, a sidewall, a top and a bottom. The sidewall is interconnected with the top and bottom in a fluid tight manner. An elongate control shaft has a first portion disposed within the cylinder and is substantially parallel with the central axis thereof. The control shaft extends in an axial direction through the top and is engaged thereby in a fluid tight manner. A second portion of the control shaft is disposed external to the cylinder. The second portion of the control shaft is configured for being pivotally coupled to at least one variable valve mechanism. A fixed vane is disposed in sealing engagement with the sidewall, top and bottom of the cylinder, and with the first portion of the control shaft. A movable vane is in sealing engagement with the top and bottom of the cylinder. The movable vane has an inner end affixed to the first portion of the control shaft, and an outer end engaging the sidewall of the cylinder in a fluid tight manner.

An advantage of the present invention is that it has fewer parts relative to a conventional actuator, and is therefore likely to be less expensive to manufacture.

Another advantage of the present invention is that it requires no lash adjustment system.

A further advantage of the present invention is that the use of a motor and gearbox is optional, and is necessary only in applications that require relatively high speed rotation and/or high amounts of torque.

A still further advantage of the present invention is that it consumes less space and is lighter in weight than conventional actuators.

BRIEF DESCRIPTION OF THE DRAWINGS

The above-mentioned and other features and advantages of this invention, and the manner of attaining them, will become apparent and be more completely understood by reference to the following description of one embodiment of the invention when read in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
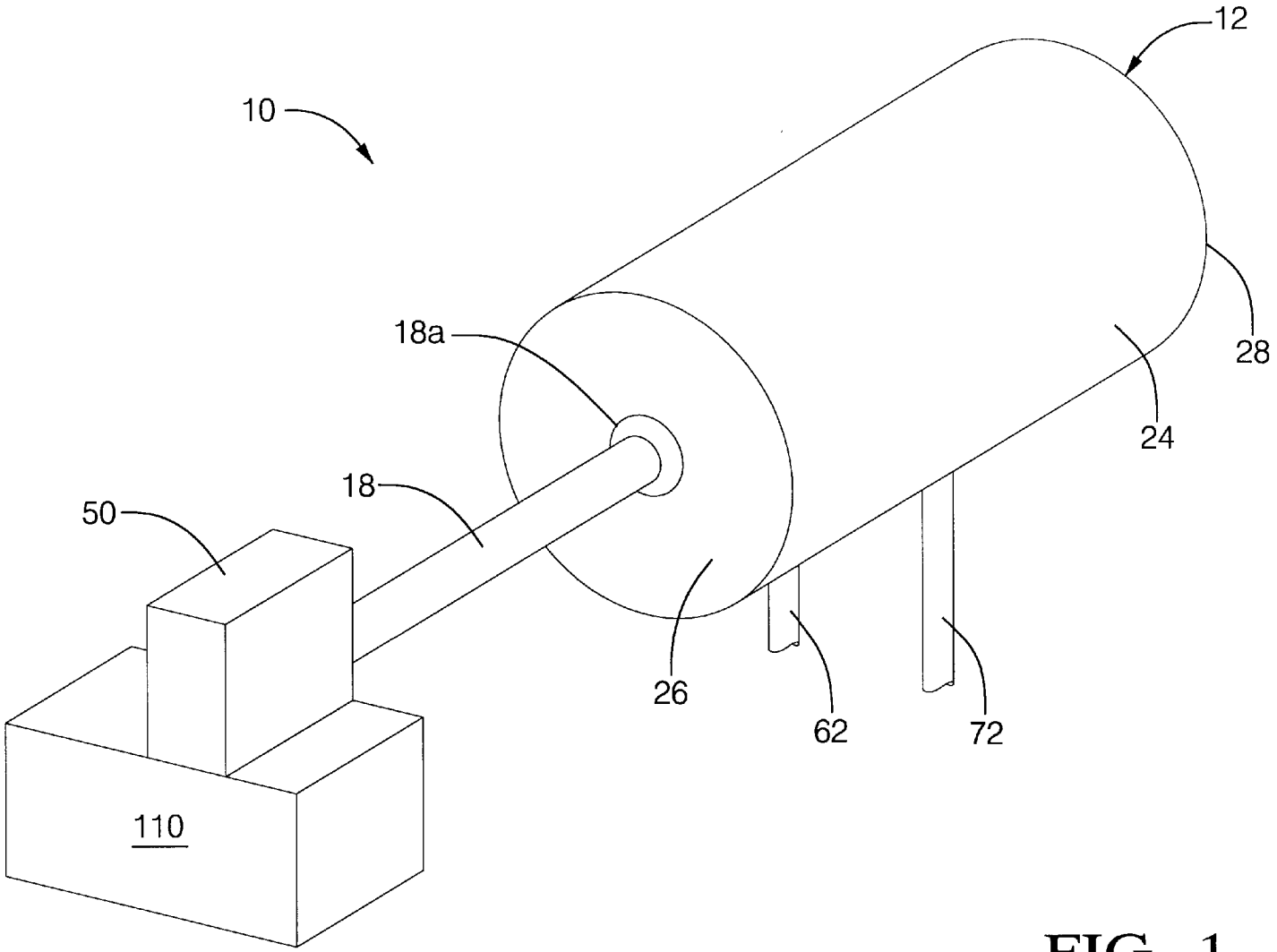
FIG. 1 is a perspective view of one embodiment of a hydraulic actuator of the present invention.
Figure 2:
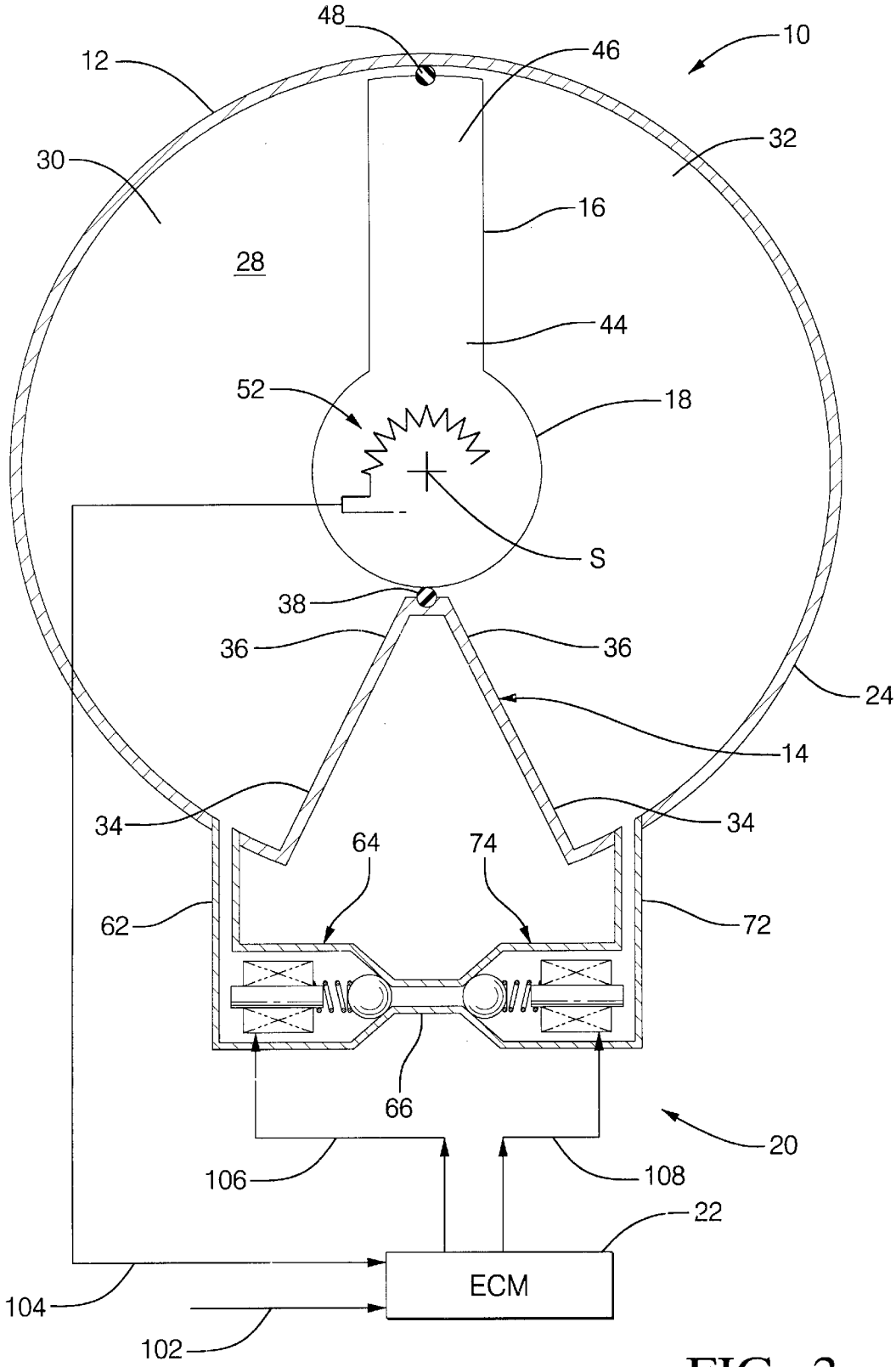
FIG. 2 is a front, cross-sectional view of the hydraulic actuator of FIG. 1.

Referring to the drawings, and particularly FIGS. 1 and 2, there is shown one embodiment of a hydraulic actuator of the present invention. Hydraulic actuator 10 includes cylinder 12, fixed vane 14, movable vane 16, control shaft 18, and valve assembly 20.

As will be discussed more particularly hereinafter, hydraulic actuator 10, dependent at least in part upon input from engine control module (ECM) 22, selectively varies the angular position of control shaft 18 relative to the central axis S thereof. Hydraulic actuator 10 rotates control shaft 18 by utilizing reflected torque rather than a motor/gearbox, and is substantially less sensitive to reflected torque than a conventional actuator.

Cylinder 12 is an elongate cylinder having central axis S, and contains a hydraulic fluid (not shown) such as, for example, oil. Cylinder 12 is attached, such as, for example, by bolts or other suitable fasteners, to an engine block or other stationary object. Cylinder 12 includes sidewall 24, top 26 and bottom 28. Each of top 26 and bottom 28 are attached in a fluid and airtight manner to sidewall 24 at respective and opposite ends (not referenced) thereof. Left chamber 30 and right chamber 32 are defined and fluidly separated by fixed vane 14, movable vane 16 and control shaft 18. A portion of control shaft 18 is disposed within cylinder 12 and a second portion of control shaft 18 is disposed external to cylinder 12. Shaft seal 18a engages top 26 and shaft 18 thereby sealing together top 26 and control shaft 18 in a fluid tight manner to prevent leakage of the hydraulic fluid contained within cylinder 12.

Fixed vane 14 is disposed within cylinder 12, and includes outer end 34 and inner end 36. Outer end 34 is fixed to and/or integral with sidewall 24 of cylinder 12. Inner seal 38 is disposed on inner end 36 of fixed vane 14 and engages control shaft 18 in a fluid tight manner. Fixed vane 14 extends axially through cylinder 12 and is in sealing engagement with each of top 26 and bottom 28 of cylinder 12.

Movable vane 16 includes inner end 44 and outer end 46. Inner end 44 is fixed to and/or integral with control shaft 18. Thus, control shaft 18 and movable vane 16 pivot or rotate as substantially one body. Outer seal 48 is disposed on outer end 46 and engages the inner surface (not referenced) of cylinder wall 24 in a fluid tight manner. Movable vane 16 extends axially through cylinder 12 and is in sealing engagement with each of the top 26 and bottom 28 of cylinder 12.

Control shaft 18 is an elongate shaft. A first portion (not referenced) of control shaft 18 is disposed within cylinder 12 and is substantially concentric therewith. Control shaft 18 extends through top 26 of cylinder 12. Top 26 engages control shaft 18 in an air and fluid tight manner. A second portion (not referenced) of control shaft 18 is disposed external to cylinder 12. One or more variable valve mechanisms 50 (FIG. 1) are pivotally or otherwise coupled to the second portion of control shaft 18. Feedback sensor 52 is disposed upon or otherwise associated with control shaft 18.

Figure 3:
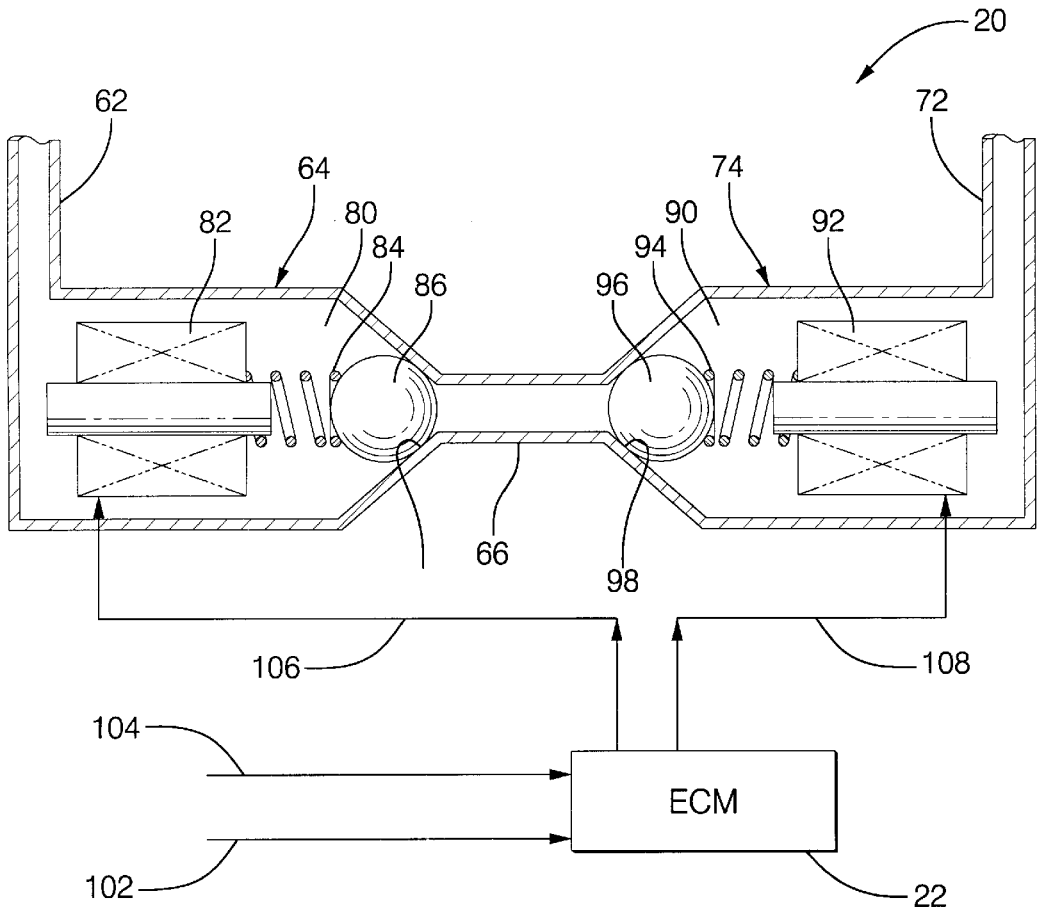
FIG. 3 is a front, cross-sectional view of the hydraulic passage of the hydraulic valve actuator of FIG. 1.

Valve assembly 20 includes left passage 62, left fluid control valve 64, connecting passage 66, right passage 72 and right fluid control valve 74. Left passage 62 fluidly connects left chamber 30 of cylinder 12 with left fluid control valve 64. Connecting passage 66 fluidly connects left fluid control valve 64 with right fluid control valve 74. Right passage 72 fluidly connects right fluid control valve 74 with right chamber 32 of cylinder 12. As best shown in FIG. 3, left fluid control valve 64 includes left valve chamber 80, left solenoid 82, left spring 84, left check ball 86 and left seat 88. Right fluid control valve 74 includes right valve chamber 90, right solenoid 92, right spring 94, right check ball 96 and right seat 98. The position of left solenoid 82 is fixed with respect to left fluid control valve 64 and the position of right solenoid 92 is fixed with respect to right fluid control valve 74. Left spring 84 biases left check ball 86 into sealing engagement with left seat 88. Similarly, right spring 94 biases right check ball 96 into sealing engagement with right seat 98. Each of left solenoid 82 and right solenoid 92 are, for example, magnetic/electrical solenoids, and left and right check balls 86, 96, respectively, are accordingly constructed of a magnetic material, such as, for example, steel or other suitable material.

Engine control module (ECM) 22 is a conventional engine control module or computer. ECM 22 includes control shaft position input 102, feedback input 104, left solenoid control output 106 and right solenoid control output 108. ECM 22 receives a control shaft position command from, for example, a throttle sensor, in the form of an electrical signal or data via input 102. ECM 22 activates one of left solenoid control output 106 or right solenoid control output 108 dependent at least in part upon the control shaft position command. Feedback input 104 is electrically connected to feedback sensor 52. ECM 22 reads the current angular position of control shaft 18 from feedback sensor 52 via feedback input 104. Left and right solenoid control outputs 106, 108 are electrically connected to and selectively activate left fluid control valve 64 and right fluid control valve 74, respectively, based at least in part upon position input 102.

Figure 4:
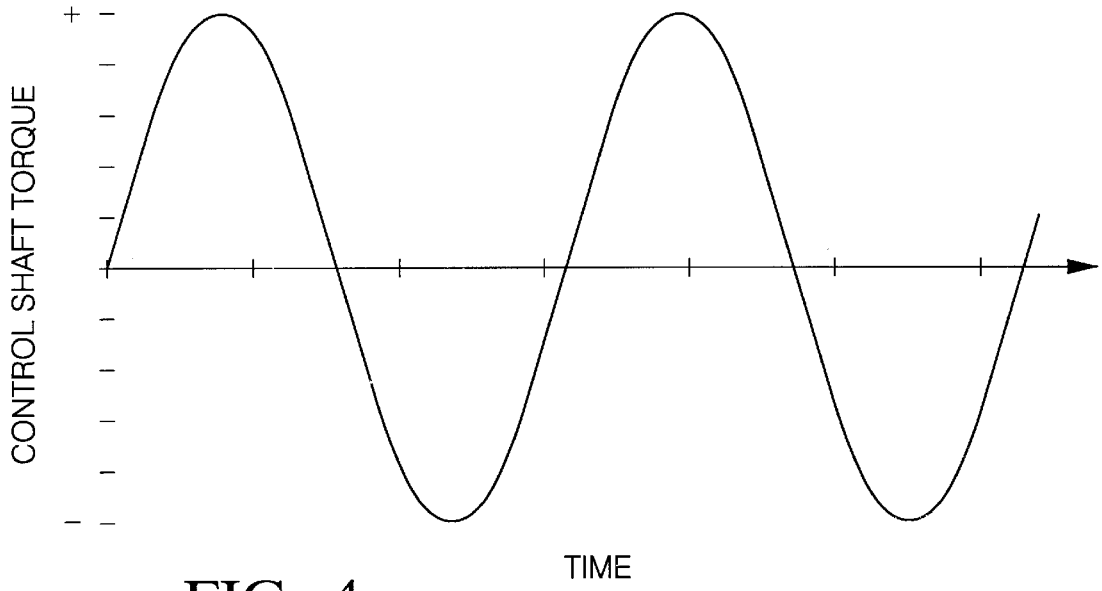
FIG. 4 is a graph of the reflected torque to which the control shaft of the hydraulic actuator of FIG. 1 is subjected plotted against time.

In use, control shaft 18 is subjected to torque due to the opening and closing of the one or more variable valve mechanisms 50 pivotally coupled to the rotating input or camshaft of engine 110 (schematically represented in FIG. 1). This torque is reflected back through control shaft 18 to actuator 10. A representation of the reflected torque is plotted versus time in FIG. 4. A positive (counter-clockwise) torque is followed by a negative (clockwise) torque, which is, in turn, followed by a positive torque, etc. In the static state, neither left solenoid 82 nor right solenoid 92 is activated by ECM 22. Therefore, left fluid control valve 64 and right fluid control valve 74 remain in the default or closed position, i.e., in sealing engagement with left seat 88 and right seat 98, respectively. More particularly, in the static state hydraulic fluid is prevented from flowing through left fluid control valve 64 by left check ball 86 being biased into sealing engagement with left seat 88 by left spring 84. Similarly, in the static state hydraulic fluid is prevented from flowing through right fluid control valve 74 by right check ball 96 being biased into sealing engagement with right seat 98 by right spring 94. Thus, hydraulic fluid within cylinder 12 is precluded from flowing between left chamber 30 and right chamber 32.

Movable vane 16 is attached to or integral with control shaft 18, and thus pivotal movement of control shaft 18 relative to central axis S requires pivotal movement of movable vane 16 relative to central axis S. Pivotal movement of movable vane 16 displaces hydraulic fluid, and forces hydraulic fluid to be exchanged, i.e., to flow, between left chamber 30 and right chamber 32. By precluding the flow of hydraulic fluid between left chamber 30 and right chamber 32, as described above, the pivotal movement of movable vane 16, and thus control shaft 18, relative to central axis S is substantially precluded. Movable vane 16, and thus control shaft 18, can pivot relative to central axis S only when hydraulic fluid is able to flow between left chamber 30 and right chamber 32. As stated above, the angular position of the control shaft relative to central axis S establishes the valve lift profile of the one or more valves associated with variable valve mechanism 50 (schematically represented in FIG. 1). By precluding the flow of hydraulic fluid between left chamber 30 and right chamber 32, control shaft 18 is held substantially stationary and the valve lift profile remains fixed. Thus, hydraulic actuator 10 is less sensitive to the effects of reflected torque than a conventional actuator.

Figure 5:
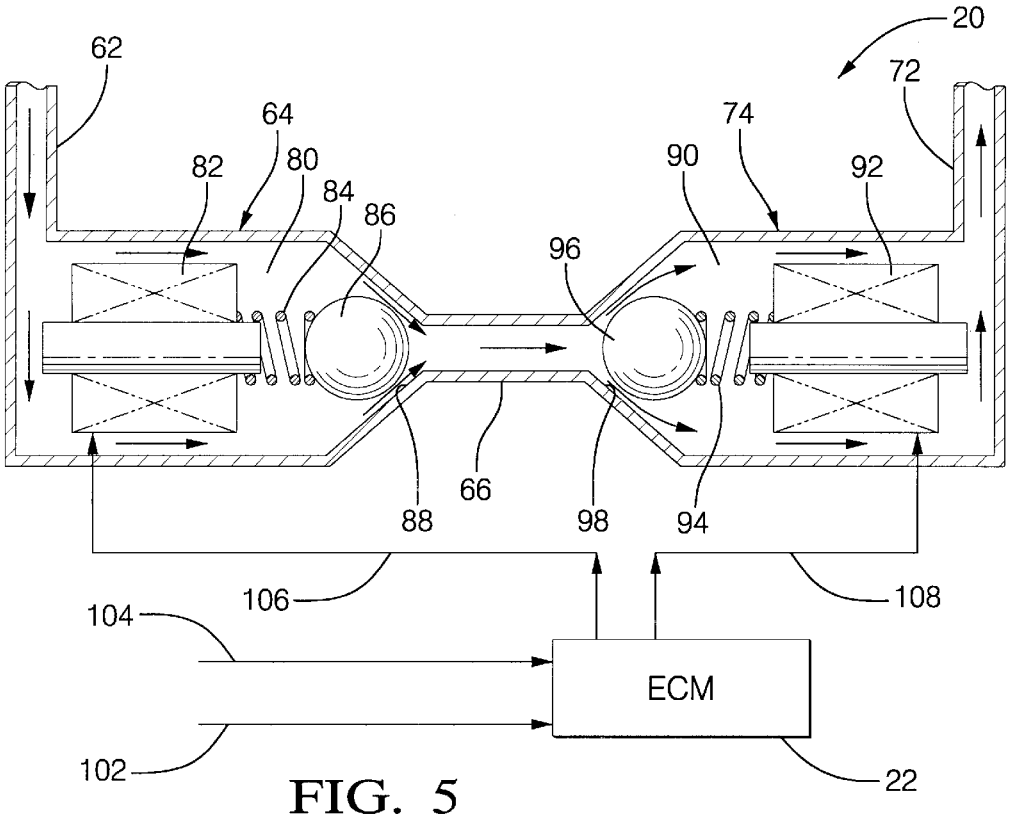
FIG. 5 is a front, cross-sectional view of the hydraulic passage of the hydraulic valve actuator of FIG. 1 having the left solenoid activated and with positive torque acting on the control shaft.
Figure 6:
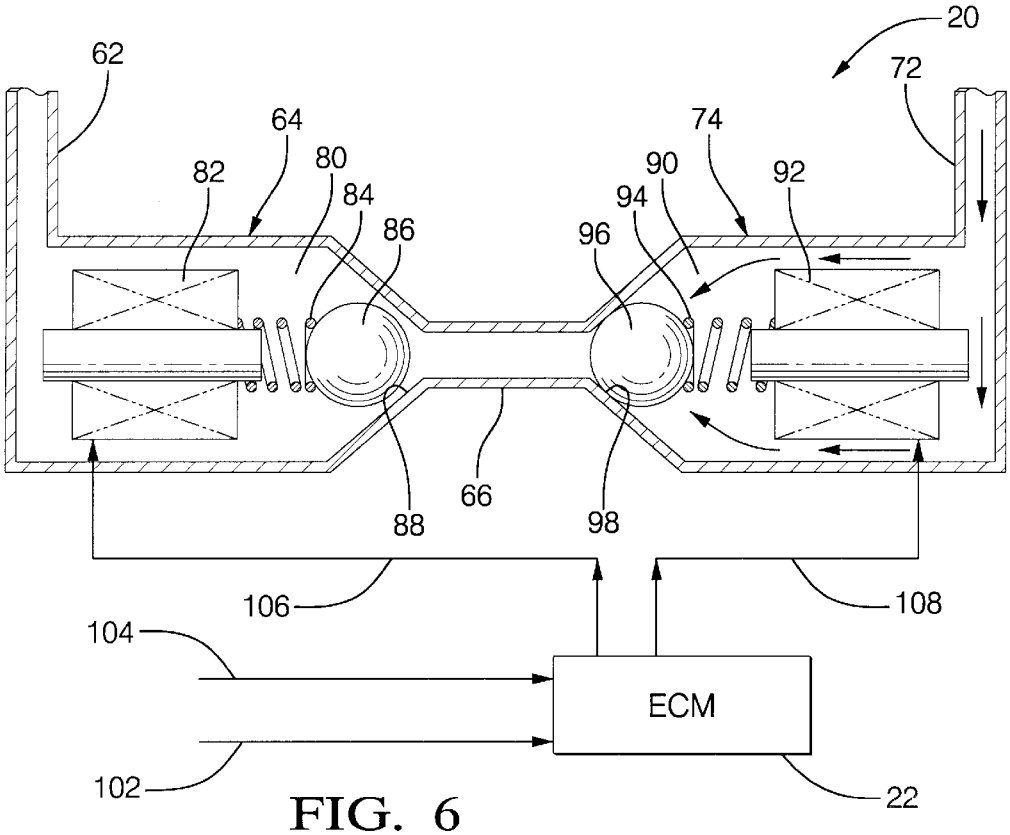
FIG. 6. is a front, cross-sectional view of the hydraulic passage of the hydraulic valve actuator of FIG. 1 having the left solenoid activated and a negative torque acting on the control shaft.

Generally, actuator 10 utilizes the reflected torque to pivot control shaft 18 relative to central axis S in response to an appropriate signal on position input 102 of ECM 22. More particularly, in response to an appropriate signal on position input 102 corresponding to, for example, a request for positive, i.e., counter-clockwise, pivotal movement of control shaft 18 to a desired position, ECM 22 activates or opens left fluid control valve 64 via an appropriate signal on left solenoid control output 106 to thereby activate left solenoid 82. As best shown in FIG. 5, activation of left solenoid 82, in turn, displaces left check ball 86 from sealing engagement with left seat 88 thereby opening fluid control valve 64 and fluidly connecting left chamber 30 with connecting passage 66. Positive, i.e., counter-clockwise, reflected torque acting upon control shaft 18 and, thus, movable vane 16 increases the pressure of the hydraulic fluid contained within left chamber 30 and decreases pressure in of the hydraulic fluid contained within right chamber 32. Left chamber 30 is fluidly connected with connecting passage 66, and thus the pressure of hydraulic fluid therein is also increased.

At a predetermined magnitude of reflected positive/counter-clockwise torque, the pressure of the hydraulic fluid within left chamber 30 and connecting passage 66 overcomes the spring force applied by right spring 94 which normally biases right check ball 96 into sealing engagement with right seat 98 of right fluid control valve 74. The increased hydraulic pressure within connecting passage 66 and left chamber 30 displaces right check ball 96 from sealing engagement with right seat 98, thereby opening right fluid control valve 74 and fluidly connecting right chamber 32 with connecting passage 66. Thus, the flow of hydraulic fluid from left chamber 30 through connecting passage 66 and into right chamber 32 is enabled. The positive/counter-clockwise reflected torque acts upon and causes control shaft 18 and movable vane 16 to pivot in a positive/counter-clockwise direction relative to central axis S, thereby forcing hydraulic fluid to flow from left chamber 30 into right chamber 32 via connecting passage 66. Thus, Actuator 10 utilizes the reflected torque to pivot control shaft 18 about central axis S.

The predetermined magnitude at which the hydraulic pressure within connecting passage 66 overcomes the spring force applied by right spring 94 to normally bias right check ball 96 into sealing engagement with right seat 98 of right fluid control valve 74, and thereby preclude the flow of hydraulic fluid between left chamber 30 and right chamber 32, is determined by the spring force of right spring 94. Right spring 94 is selected to have a spring force which is less than a predetermined level or percentage of the peak magnitude of reflected torque that is expected in a particular application.

In the event that the positive/counter-clockwise reflected torque acting upon control shaft 18 and movable vane 16 decreases below a predetermined level or becomes negative prior to control shaft 18 completing rotation to the desired position, rotation of control shaft 18 slows and/or momentarily ceases. The decrease in positive torque results in a decrease in the hydraulic pressure within left chamber 30 and within connecting passage 66, and an increase in the hydraulic pressure within right chamber 32. The decrease in hydraulic pressure within left chamber 30 and connecting passage 66, and the increase in hydraulic pressure within right chamber 32, act to conjunctively assist the spring force of right spring 94 to bias right check ball 96 back into sealing engagement with right seat 98 of right fluid control valve 74, thereby closing right fluid control valve 74. The closing of right fluid control valve 74 precludes the flow of hydraulic fluid through connecting passage 66 from left chamber 30 into right chamber 32. With the flow of hydraulic fluid between left chamber 30 and right chamber 32 precluded, control shaft 18 is held substantially stationary. Control shaft 18 will again be caused to pivot in a positive/counter-clockwise direction relative to central axis S when the reflected torque returns to and/or exceeds the predetermined magnitude and polarity/direction, and so long as left solenoid 82 remains activated.

The operation of actuator 10 for clockwise/negative rotation of control shaft 18 is substantially similar to the operation thereof during counter-clockwise/positive rotation of control shaft 18 as described above. More particularly, in response to an appropriate signal on position input 102 corresponding to a request for negative/clockwise rotation of control shaft 18 to a desired position, ECM 22 issues an appropriate signal on right solenoid control output 108 to thereby activate right solenoid 92. Activation of right solenoid 92, in turn, displaces right check ball 96 from sealing engagement with right seat 98, thereby opening right fluid control valve 74 and fluidly connecting right chamber 32 with connecting passage 66. Negative, i.e., clockwise, reflected torque acting upon control shaft 18 and, thus, movable vane 16 increases the pressure of the hydraulic fluid contained within right chamber 32 and decreases the pressure of the hydraulic fluid contained within left chamber 30. Right chamber 32 is fluidly connected with connecting passage 66, and thus the pressure of hydraulic fluid therein is also increased.

At a predetermined magnitude of reflected negative/clockwise torque, the pressure of the hydraulic fluid within right chamber 32 and connecting passage 66 overcomes the spring force applied by left spring 84 which normally biases left check ball 86 into sealing engagement with left seat 88 of left fluid control valve 64. The increased hydraulic pressure displaces left check ball 86 from sealing engagement with left seat 88, thereby opening left fluid control valve 64 and fluidly connecting left chamber 30 with connecting passage 66. Thus, the flow of hydraulic fluid from right chamber 32 through connecting passage 66 and into left chamber 30 is enabled. The negative/clockwise reflected torque acts upon and causes control shaft 18 and movable vane 16 to pivot in a negative/clockwise direction relative to central axis S, thereby forcing hydraulic fluid to flow from right chamber 32 into left chamber 30 via connecting passage 66.

In the event that the negative/clockwise reflected torque acting upon control shaft 18 and movable vane 16 decreases below a predetermined level or becomes positive prior to control shaft 18 completing rotation to the desired position, rotation of control shaft 18 slows and/or momentarily ceases. Thus, the hydraulic pressure within right chamber 32 and within connecting passage 66 decreases until the spring force of left spring 84 overcomes the hydraulic pressure acting on left check ball 86. The spring force of left spring 84 biases left check ball 86 back into sealing engagement with left seat 88 of left fluid control valve 64, thereby closing left fluid control valve 64. The closing of left fluid control valve 64 precludes the flow of hydraulic fluid through connecting passage 66 from right chamber 32 into left chamber 30. With the flow of hydraulic fluid between right chamber 32 and left chamber 30 precluded, control shaft 18 is held substantially stationary. Control shaft 18 will again be caused to pivot in a negative/clockwise direction relative to central axis S when the reflected torque returns to and/or exceeds the predetermined magnitude in the same polarity/direction, and so long as right solenoid 92 remains activated.

The spring force of right spring 94 determines the magnitude of hydraulic pressure within left chamber 30 and connecting passage 66 that is required to force or push open right fluid control valve 74 during counter-clockwise/positive rotation of control shaft 18. Similarly, the spring force of left spring 84 determines the magnitude of hydraulic pressure within right chamber 32 and connecting passage 66 that is required to force or push open left fluid control valve 64 during clockwise/negative rotation of control shaft 18. The spring forces of left spring 84 and right spring 94 are selected based, at least in part, upon the expected peak magnitude of reflected torque and the percentage of that peak reflected torque at which rotation of control shaft 18 is desired for the particular application or class of applications in which Actuator 10 will be employed.

Actuator 10 is configured to preferentially pivot control shaft 18 relative to central axis S in a predetermined direction by selecting the spring force of the spring which opposes rotation thereof in the preferred direction to be less than the spring force of the spring associated with the solenoid that is actuated to initiate rotation in the preferred direction and which opposes rotation in the direction opposite to the preferred direction. Thus, the spring opposing rotation in the preferred direction and having a lower spring force is overcome by a lower level of hydraulic pressure/reflected torque than is the spring having a higher spring force and which opposes rotation in the direction that is opposite to the preferred direction. For example, to preferentially rotate control shaft 18 in a clockwise direction, left spring 84 is chosen to have a spring force that is less than the spring force of right spring 94. Therefore, left spring 84 is displaced from sealing engagement with left seat 88 by a lower hydraulic pressure than is required to displace right spring 94 from sealing engagement with right seat 98. Thus, control shaft 18 is rotated in a clockwise direction at a lower magnitude of reflected torque than is required to rotate control shaft 18 in a counter-clockwise direction.

In the embodiment shown, actuator 10 does not include a gearbox or electric motor. However, it is to be understood that a gearbox and electric motor can be associated with actuator 10. In such an embodiment, ECM 22 commands the electric motor to apply a torque to control shaft 18 and appropriately activates hydraulic actuator 10 to enable rotation of control shaft 18. The motor and gearbox associated with hydraulic actuator 10 can be configured with substantially smaller torque/power capabilities, and can therefore be of a smaller size and lighter weight, relative to a conventional actuator since hydraulic actuator 10 reduces the sensitivity of actuator 10 to reflected torque opposing the rotation of control shaft 18 by substantially precluding control shaft 18 from pivoting in the direction opposite to the desired direction of rotation. Such an embodiment may be particularly useful for conditions when engine oil viscosity is high, such as, for example, at engine start or cold operation, and when torque on control shaft 18 is low, such as, for example, when variable valve mechanism 50 places the valves in a low lift profile.

In the embodiment shown, the reflected torque to which control shaft 18 is subjected is depicted (FIG. 4) as a sine wave having peaks of equal magnitude. However, it is to be understood that the present invention can utilize reflected torque having virtually any periodic waveform shape and/or function, and having different and/or varying peak magnitudes of positive and negative torque.

In the embodiment shown, fluid control valves 64 and 74 are configured as check valves. However, it is to be understood that fluid control valves 64 and 74 can be alternately configured, such as, for example, a disk valve or other suitable fluid control valves.

In the embodiment shown, hydraulic actuator 10 is disclosed as being for use with variable valve mechanism 50. However, it is to be understood that hydraulic actuator 10 can be alternately configured for use with various other mechanisms subjected to reflected torque, such as, for example, machine tools manufacturing machines.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A variable valve mechanism having a hydraulic actuator, said hydraulic actuator comprising:

an elongate cylinder having a central axis, a sidewall, a top and bottom, said sidewall interconnected with said top and bottom in an air and fluid tight manner;

an elongate control shaft having a first portion disposed within said cylinder and being substantially parallel with said central axis, said control shaft extending in an axial direction through said top, said top sealingly engaging said control shaft, a second portion of said control shaft being disposed external to said cylinder, said second portion of said control shaft being pivotally coupled to said variable valve mechanism;

a fixed vane disposed in sealing engagement with said sidewall, said top, said bottom and said first portion of said control shaft; and a movable vane in sealing engagement with said top and said bottom, said movable vane having an inner end and an outer end, said inner end being affixed to said first portion of said control shaft, said outer end sealingly engaging said sidewall.

2. The hydraulic actuator of claim 1, further comprising:

a right chamber conjunctively defined by said fixed vane, said movable vane and said sidewall, said right chamber configured for containing a fluid under pressure; and a left chamber conjunctively defined by said fixed vane, said movable vane and said sidewall, said left chamber configured for containing a fluid under pressure.

3. The hydraulic actuator of claim 2, further comprising:

a left passage fluidly connected to said left chamber;

a right passage fluidly connected to said right chamber; and valve means selectively placing said left passage and said right passage in fluid communication with each other to thereby place said left chamber and said right chamber in fluid communication.

4. The hydraulic actuator of claim 3, wherein said valve means comprises:

a left fluid control valve in fluid communication with said left passage;

a right fluid control valve in fluid communication with said right passage; and a connecting passage fluidly connecting said left fluid control valve and said right fluid control valve.

5. An internal combustion engine having a variable valve mechanism, said variable valve mechanism including a hydraulic actuator, said hydraulic actuator comprising:

an elongate cylinder having a central axis, a sidewall, a top and bottom, said sidewall interconnected with said top and bottom in an air and fluid tight manner;

an elongate control shaft having a first portion disposed within said cylinder and being substantially parallel with said central axis, said control shaft extending in an axial direction through said top, said top engaging said control shaft in an air and fluid tight manner, a second portion of said control shaft being disposed external to said cylinder, said second portion of said control shaft being pivotally coupled to said variable valve mechanism;

a fixed vane disposed in sealing engagement with said sidewall, said top, said bottom and said first portion of said control shaft; and a movable vane in sealing engagement with said top and said bottom, said movable vane having an inner end and an outer end, said inner end being affixed to said first portion of said control shaft, said outer end engaging said sidewall in an air and fluid tight manner.

6. The internal combustion engine of claim 5, wherein said hydraulic actuator further comprises:

a right chamber conjunctively defined by said fixed vane, said movable vane and said sidewall, said right chamber configured for containing a fluid under pressure; and a left chamber conjunctively defined by said fixed vane, said movable vane and said sidewall, said left chamber configured for containing a fluid under pressure.

7. The internal combustion engine of claim 6, wherein said hydraulic actuator further comprises:

a left passage fluidly connected to said left chamber;

a right passage fluidly connected to said right chamber; and valve means selectively placing said left passage and said right passage in fluid communication with each other to thereby place said left chamber and said right chamber in fluid communication.

8. The internal combustion engine of claim 7, wherein said valve means of said hydraulic actuator comprise:

a left fluid control valve in fluid communication with said left passage;

a right fluid control valve in fluid communication with said right passage; and a connecting passage fluidly connecting said left fluid control valve and said right fluid control valve.

* * * * *